United States Patent [19]

DeGrave

[11] Patent Number: 4,875,262

[45] Date of Patent: Oct. 24, 1989

[54] PROCESS FOR MANUFACTURING A GRAIN CHILL ROLLER

[75] Inventor: Gilbert F. DeGrave, Rochester, N.Y.

[73] Assignee: Eastman Kodak Company, Rochester, N.Y.

[21] Appl. No.: 248,469

[22] Filed: Sep. 23, 1988

[51] Int. Cl.[4] ..... C25D 5/48; C25D 7/00

[52] U.S. Cl. ..... 29/121.8; 29/132; 29/148.4 D; 204/25; 204/35.1; 204/36; 204/40

[58] Field of Search ..... 204/25, 35.1, 36, 40; 29/121.1, 132, 148.4 D, 121.8

[56] References Cited

U.S. PATENT DOCUMENTS 2,114,072 4/1938 Cleveland ..... 204/25 X
3,869,535 3/1975 Coll-Palagos ..... 264/219
4,426,411 1/1984 Sasaki et al. ..... 427/349

*Primary Examiner*—John F. Niebling
*Assistant Examiner*—William T. Leader
*Attorney, Agent, or Firm*—G. Herman Childress

[57] ABSTRACT

A grain chill roller is manufactured by electroplating a layer of copper onto the surface of the roller. The layer of copper is than abrasively blasted with glass beads to produce surface features of a substantially uniform depth, and then the surface is abrasively blasted with small particles of silicon dioxide to modify the pattern of features formed by the previous blasting operation. The resulting surface is bright nickel electroplated to level the down pattern of the surface without eliminating the down pattern. The roller is used in the manufacture of resin coated photographic paper, for example.

6 Claims, 2 Drawing Sheets

PROCESS FOR MANUFACTURING A GRAIN CHILL ROLLER

BACKGROUND OF THE INVENTION

The present invention relates to the manufacture of grain chill rollers of the kind used for manufacturing resin coated photographic paper, for example.

It is known to produce photographic paper having a resin coated on one surface thereof with the resin having a surface texture. This kind of paper is made by a thermoplastic embossing process in which raw (uncoated) paper stock is coated with a molten resin, such as polyethylene. The paper with the molten resin thereon is brought into contact with a grain chill roller having a surface pattern. Chilled water is pumped through the roller to extract heat from the resin, causing it to solidify and adhere to the paper. During this process the surface texture on the chill roller's surface is embossed into the resin coated paper. Thus, the surface pattern on the chill grain roller is critical to the surface produced in the resin on the coated paper.

One known prior process for preparing grain chill rollers comprises several major steps. These steps include electroplating copper over a steel shell, creating a main surface pattern using a mechanical engraving process and then abrasively blasting the engraved surface to disguise tool lines caused by misalignment of the engraving tool. Finally, the roller is bright nickel electroplated to produce a durable glossy surface.

During the mechanical engraving step, an engraving tool, essentially a knurl, is forced against the roller surface to deform the copper. The pattern on the engraving tools have been specially designed for the manufacture of grain chill rollers. The engraving process has many limitations. For example, any misalignment of the tool will always cause tool lines in the surface. Tool lines produce a directional or linear appearance to the surface texture leading to a non-uniform paper product. Also, the engraving process previously used requires that the cooper layer have a hardness of between 45 HRB and 55 HRB. If the copper layer is too hard the tool is unable to plastically deform the copper enough to completely emboss the pattern on the chill roller surface. On the other hand, if the copper is too soft any slight misalignment of the engraving tool will cause unacceptable tool lines.

The prior engraving process requires a layer of copper having a minimum thickness of about 0.014 inches. The engraving process typically needs to be performed by an outside vendor having the necessary engraving equipment to provide the high quality surface required for grain chill rollers. Because such rollers may be three feet or so in diameter and about eight feet long, the engraving step can take several weeks to complete. Moreover, engraving is an expensive process that constitutes a significant portion of the total cost of manufacture of a grain chill roller. Accordingly, it is desirable to eliminate the engraving step in the manufacture of grain chill rollers.

SUMMARY OF THE INVENTION

It is an object of the present invention to eliminate the need for the mechanical engraving step in the manufacture of grain chill rollers while maintaining a surface texture on the roller surface that produces the desired texture in resin coated paper produced using the roller.

In accordance with the present invention a roller is manufactured by a process including the steps of electroplating a layer of cooper onto the surface of a roller, and then abrasively blasting the surface of the copper layer with glass beads to create a surface texture with hemispherical down features having a substantially uniform depth. Then the surface of the copper layer is abrasively blasted with particles of silicon dioxide to modify the pattern formed during the step of blasting with glass beads. The resulting blasted surface is bright nickel electroplated to a depth that results in a leveling of the down pattern of the surface but without eliminating the down pattern in order to provide a high gloss in the surface formed during the thermoplastic embossing process.

The invention and its objects and its advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
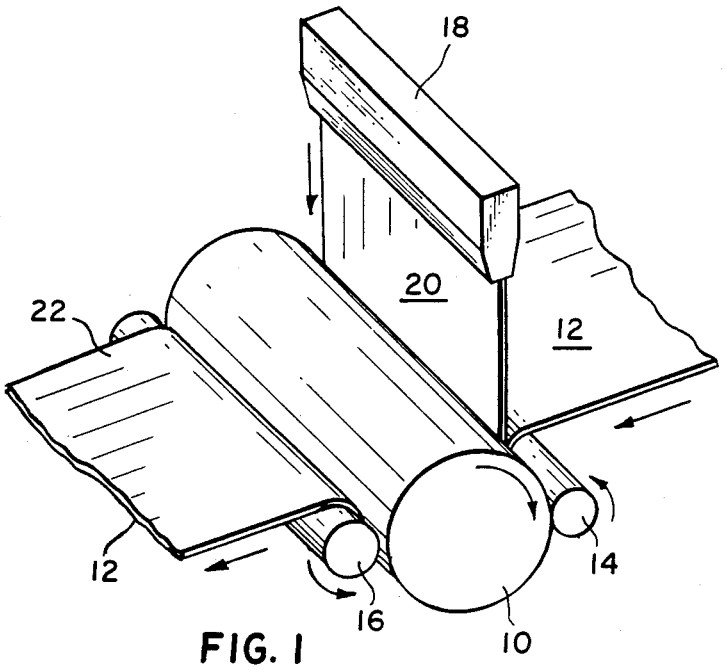
FIG. 1 is a diagrammatic view illustrating the use of a grain chill roller of the invention in a resin coating process.

The present invention relates to the manufacture of a grain chill roller as generally designated 10 in FIG. 1. This Figure illustrates the use of the roller for applying a coating of resin to a web of photographic paper. More specifically, a web 12 of uncoated paper is fed between the roller 10 and a nip roller 14, and travels approximately 180 degrees around the roller 10 to a stripping roller 16. After the paper passes between rollers 10 and 16 it is pulled away from the chill roller.

An extruder 18 delivers a curtain of hot, molten resin material 20, such as molten polyethylene, into the nip between rollers 10 and 14 so that the upper surface of the uncoated web 12 receives the molten resin. Cold water is circulated through the chill roller so that the molten resin is cooled as it travels between the nip roller 14 and the stripping roller 16. When the web 12 is pulled away from the chill roller the coating 22 of resin material is firmly adhered to the upper surface of the paper. As the resin cools, the surface texture on the chill roller's surface is embossed into the resin on the paper. The resin coating process as generally illustrated in FIG. 1 and described hereinabove has been used for a number of years to coat photographic paper with resinous material.

Figure 2:
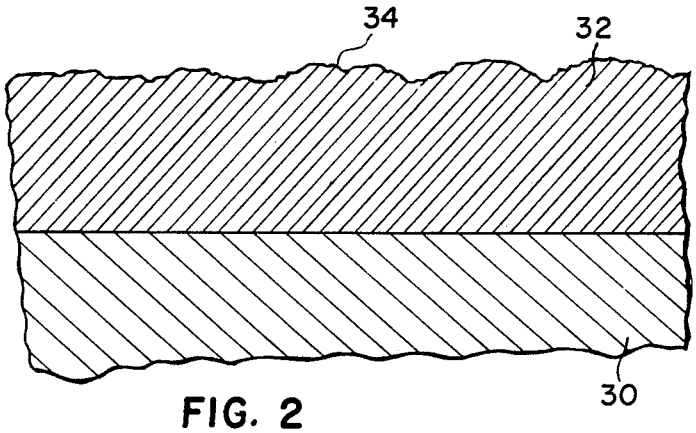
FIG. 2 is an enlarged, fragmentary cross section of an electroplated roller after it has been diamond turned and polished.

The process of the present invention for manufacturing a roller 10 can be applied to cylindrical shells or base rollers of various kinds, for example, a steel shell designated 30 in FIG. 2. A typical roller shell used for a chill roll can be approximately three feet in diameter and eight feet or more in length. However, the process of the invention is applicable to roller shells of substantially any size.

Initially shell 30 is electroplated with a layer of copper 32 that substantially completely covers the surface of the shell 30. The electroplated copper layer seals any imperfections in the steel shell and provides a good bonding layer for the nickel layer described later. The hardness of the copper layer can vary over a wide range of values. More specifically, a layer hardness of between 45 HRB to 73 HRB has been found to be satisfactory for the process of this invention. A hardness of from 60–65 HRB is preferred. The copper layer 32 preferably has an average thickness of 0.010 to 0.015 inches, and can have an average thickness as small as 0.008 inches. In the prior manufacturing process described earlier in which layer 32 was engraved, a minimum thickness of 0.014 inches of copper was considered essential.

Figure 3:
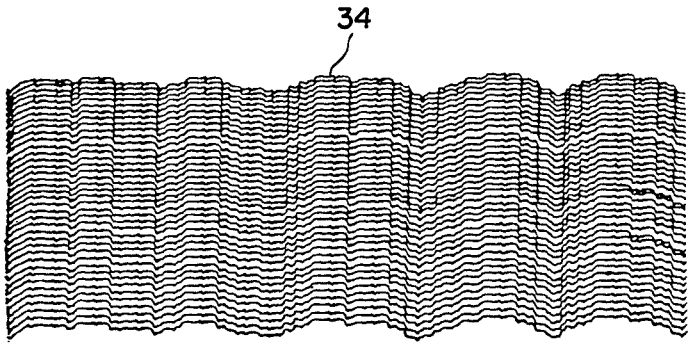
FIG. 3 is a topograph of the surface of the FIG. 2 roller.

The copper layer 32 is machined, preferably by using a diamond lathe cutting tool, to establish the cylindrical geometry of the chill roller and to produce a good surface finish 34. The finish of surface 34 after diamond turning is approximately 20 to 25 microinches Ra. The term Ra refers to the roughness average and is sometimes referred to as C.L.A. or AA. The roughness average is the arithmetic average of all departures of the roughness profile from the mean line. It is measured in microinches. A topograph of the diamond turned surface is illustrated in FIG. 3. Drawing FIGS. 2 and 3 are aligned so that the surface characteristics shown in FIG. 2 in section are directly above the corresponding portion of the surface shown in FIG. 3.

Figure 4:
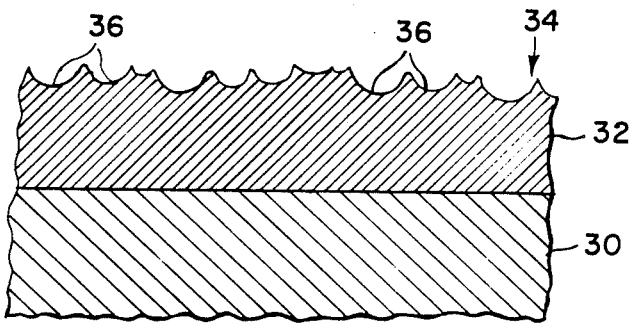
FIG. 4 is a fragmentary cross section of a roller in which the surface shown in FIG. 2 has been abrasively blasted with glass beads.

After the machining and optional polishing operation, surface 34 of the copper layer 32 is abrasively blasted with glass beads to create a surface texture illustrated in FIG. 4. More specifically, the surface texture comprises a multiplicity of hemishperical down features 36 that extend throughout the length and the circumference of the surface 34 of layer 32.

The glass bead blasting operation preferably is carried out using an automated direct pressure system in which the nozzle feed rate, nozzle distance from the roller surface 34, the roller rotation rate during the blasting operation and the velocity of the glass particles are accurately controlled to essentially constant values.

The hemispherical down features 36 formed during the glass bead blasting operation have a depth that is determined by the momentum of the glass beads as they strike the copper surface. Preferably the size of the glass beads is substantially uniform so that the mass of each bead is also constant. Thus, the momentum of the glass bead is dependent only on the velocity of the beads. The velocity of the beads, in turn, is influenced by the nozzle geometry and the blasting pressure utilized. Since the nozzle geometry is constant, the air pressure is the only variable that determines the depth of the down features 36. Air pressure is controlled to a substantially constant pressure. Thus, the depth of the down features can be accurately controlled and a substantially uniform depth is obtained. Air pressures ranging from 3 to 7 psig are preferred for the process of the invention.

The number of the down features 36 is determined by the bead size and the pattern depth. Larger bead diameters and deeper patterns result in fewer numbers of features in a given area. Therefore the number of features is inherently determined by the bead size and the pattern depth. Preferably the glass beads used conform to military size and shape specification MIL-G-9954A No. 4.

The pattern depth obtained by bead blasting can be varied between about 500 to 700 microinches, but preferably is between 550 and 650 microinches. Because of the ductility of copper and the mass of the glass beads, extremely low pressures are required to achieve pattern depth within this range. Pattern depth within this range can be obtained with pressures of between 3 and 7 psig using a direct pressure blasting system.

The process of the invention utilizing glass bead blasting is elatively insensitive to the hardness of the copper layer 32 as compared to the engraving step used in the prior process described at the beginning of this specification. As indicated previously, copper hardness varying from 45 to 73 HRB have been used successfully with little effect on the blasting pressure required to obtain the desired pattern depth. By comparison, the prior process using an engraving step required a copper hardness of between 45 and 55 HRB. If the copper layer were too hard, the engraving tool was unable to plastically deform the copper sufficiently to emboss the pattern on the roll surface, but if the copper was too soft any slight misalignment of the engraving tool caused unacceptable tool lines. Also, the glass bead blasting step enables the thickness of the copper layer to be as small as 0.008 inches with no adverse effects whereas the prior engraving step required a minimum thickness of 0.014 inches of copper.

Figure 5:
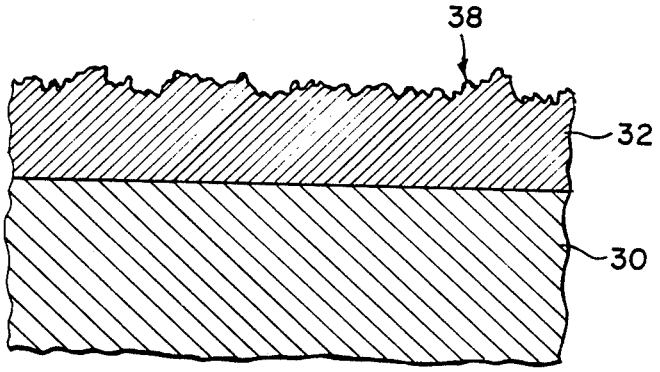
FIG. 5 is a view similar to FIG. 4 showing the roller after its surface has been abrasively blasted with silicon dioxide particles.

The next step in the manufacture of the grain chill roll 10 is a surface texturing step for the copper layer 32. The preferred surface texturing process comprises abrasively blasting the surface of layer 32 with particles of silicon dioxide to modify the surface pattern shown in FIG. 4 to the pattern shown in FIG. 5. As in the glass bead blasting operation previously described, the pattern depth resulting from the silicon dioxide blasting step is controlled by the air pressure used since other factors such as bead size, mass of particle, etc., are constant. The surface texturing step can use silicon dioxide particles of between 100 and 150 U.S. standard mesh size particles. The resulting surface, designated 38 in FIG. 6 retains the general pattern of down features shown at 36 in FIG. 4, but introduces an increased number of smaller down patterns within the overall surface configuration.

Figure 6:
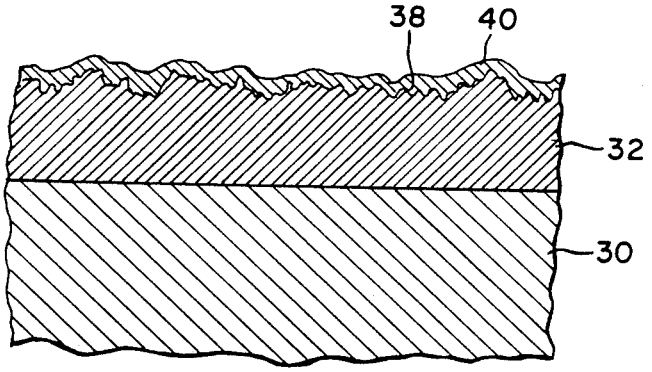
FIG. 6 is a cross section view of the FIG. 5 roller after it has been bright nickel electroplated.

The final step in the process comprises bright nickel electroplating the blasted copper surface 38 to provide a surface layer of bright nickel designated 40 in FIG. 6. Preferably, the thickness of layer 40 is about 350 to 450 microinches. The bright nickel deposited during the electroplating step smoothes out the surface 38 of the copper layer and produces a reflective and durable surface. Because of the release characteristics of the bright nickel surface, the resin 20 will not adhere to the surface of the roller. Preferably the electroplating step is carefully controlled so that the final depth of the electroplated surface texture is within plus or minus 50 microinches. This will assure proper gloss and sensitometry of the resin coated paper prepared by the process described in connection with FIG. 1.

The leveling characteristics of the bright nickel plating process cause the resulting surface texture to be an inverse function of the plating time. More specifically, the longer plating time produces smoother, higher gloss surfaces. Knowing the surface texture of surface 38 before the plating process, the duration of plating is determined based on historical results and experience.

Online inspection equipment can be used to indicate when the desired surface texture of electroplated nickel layer 40 has been achieved, and thus when to stop the plating step. This equipment may comprise a gloss meter capable of detecting small changes in specular reflection of the surface covered with a thin layer of liquid. The final surface texture achieved can be varied depending upon the characteristics that the manufacturer desires to impart to the resin coating applied to the web 12 by the process described hereinbefore with regard to FIG. 1.

Coated paper produced by the process described relative to FIG. 1 using the chill grain roller 10 of the invention has a surface texture characteristic that is similar to prior grain chill rollers manufactured using a mechanical engraving step. However, eliminating the engraving step provides a number of desirable advantages. For example, any misalignment of the tool used for engraving produces tool lines in the surface which result in a directional or linear appearance to the surface texture leading to non-uniform paper product. Such lines are eliminated by the glass bead abrasive blasting step. In addition, the engraving process required a copper hardness within narrow limits, and a thicker copper layer. More specifically, the prior process required a hardness of about 45 to 55 HRB and a minimum thickness of 0.014 inches for the copper layer compared to a hardness of about 45 to 73 HRB and a thickness of 0.008 inches for the process of the present invention.

Another important advantage resulting from elimination of the mechanical engraving step is a significant cost reduction. The cost of the engraving step is about 10 to 12 times more expensive than the bead blasting step that replaces it. In addition, the engraving step required 8 to 10 times as many man hours to complete as does the glass bead blasting step that replaces it.

The invention has been described in detail with particular reference to a preferred embodiment thereof, but it will be understood that variations and modifications can be effected within the spirit and scope of the invention.

What is claimed is:

1. A manufacturing process for preparing a surface of a roller for use in a thermoplastic embossing process, the process comprising the steps of:

electroplating a layer of copper onto the surface of a roller, abrasively blasting the surface of the copper layer with glass beads to create a surface texture with hemishperical down features having a substantially uniform depth, abrasively blasting the copper surface with particles of silicon dioxide to modify the pattern formed during the step of blasting with glass beads and create a textured surface, and bright nickel electroplating the blasted surface to a depth that results in a leveling of the down pattern of the surface without eliminating the down pattern in order to avoid a high gloss surface in the surface formed during the thermoplastic embossing process.

2. The invention as set forth in claim 1 further comprising machining the copper layer to establish a cylindrical geometry and then polishing the layer to produce a smooth surface prior to glass blasting the layer.

3. The invention as set forth in claim 1 wherein the glass bead blasting step produces hemispherical down features having a depth of between about 500 to 700 microinches, and the silicon dioxide blasting step is carried out with particles of silicon dioxide of between 100 and 150 U.S. standard mesh size.

4. The invention as set forth in claim 1 wherein the step of electroplating a layer of copper onto the roller is controlled to produce a copper layer of about 0.008 inches or greater and a hardness of about 45 to 73 HRB.

5. A roller manufactured according to the process of the claim 1.

6. A manufacturing process for preparing a surface of a roller for use in a thermoplastic embossing process, the process comprising the steps of:

electroplating onto the surface of a roller a layer of copper having a thickness of 0.008 inches or greater and a layer hardness of about 45 to 73 HRB machining the surface of the layer to establish a cylindrical geometry, polishing the machined surface to smooth the surface, abrasively blasting the surface of the copper layer with glass beads to create a surface texture with hemispherical down features having a substantially uniform depth of between 550 and 650 microinches, abrasively blasting the copper surface with particles of silicon dioxide having a particle size of between 100 and 150 U.S. standard mesh size to modify the pattern formed during the step of blasting with glass beads and create a textured surface, and bright nickel electroplating the blasted surface to a depth that results in a leveling of the down pattern of the surface without eliminating the down pattern in order to avoid a high gloss surface in the surface formed during the thermoplastic embossing process.

* * * * *

UNITED STATES PATENT AND TRADEMARK OFFICE

CERTIFICATE OF CORRECTION

PATENT NO. : 4,875,262

DATED : October 24, 1989

INVENTOR(S) : DeGrave

It is certified that error appears in the above-identified patent and that said Letters Patent is hereby corrected as shown below:

On the title page

Line [75] of Patent Heading should be changed from:

"Inventor: Gilbert F. DeGrave, Rochester, N.Y."

to:

--- Inventors: Daniel C. Lioy, Rochester, N.Y.
Roger S. Haas, Fairport, N.Y.
Arlin L. McKim, Webster, N.Y.
Gilbert F. DeGrave, Rochester, N.Y.---

Signed and Sealed this

Ninth Day of October, 1990

*Attest:*

*Attesting Officer*

HARRY F. MANBECK, JR.

*Commissioner of Patents and Trademarks*